US011692367B2

(12) United States Patent
McCutchen

(10) Patent No.: US 11,692,367 B2
(45) Date of Patent: Jul. 4, 2023

(54) SKIMMER WITH FLEXIBLE PERIPHERAL MEMBRANE, AND RELATED SKIMMER KIT WITH MULTIPLE FLEXIBLE PERIPHERAL MEMBRANES

(71) Applicant: James McCutchen, Greer, SC (US)

(72) Inventor: James McCutchen, Greer, SC (US)

( * ) Notice: Subject to any disclaimer, the term of this patent is extended or adjusted under 35 U.S.C. 154(b) by 149 days.

(21) Appl. No.: 17/178,466

(22) Filed: Feb. 18, 2021

(65) Prior Publication Data

US 2021/0285248 A1 Sep. 16, 2021

Related U.S. Application Data

(60) Provisional application No. 62/980,414, filed on Feb. 23, 2020.

(51) Int. Cl.
*E04H 4/12* (2006.01)

(52) U.S. Cl.
CPC ..... *E04H 4/1263* (2013.01)

(58) Field of Classification Search
CPC ..... E04H 4/1263; E04H 4/1254
USPC ..... 210/167.2, 242.1, 242.3
See application file for complete search history.

(56) References Cited

U.S. PATENT DOCUMENTS 3,722,689 A * 3/1973 Markel ..... E02B 15/107 210/776
4,224,162 A * 9/1980 Ayroldi ..... E02B 15/106 210/411
5,290,434 A 3/1994 Richard
5,549,817 A 8/1996 Horsley et al.
5,618,410 A 4/1997 Wallace et al.
5,820,751 A 10/1998 Faircloth, Jr.
6,126,824 A * 10/2000 Hanford ..... C02F 1/40 210/776

(Continued)

FOREIGN PATENT DOCUMENTS

CA 2096341 8/1992
KR 10-20040042229 5/2004

(Continued)

OTHER PUBLICATIONS

Search Report for International Application No. PCT/US2014/038453, dated Sep. 26, 2014.

(Continued)

*Primary Examiner* — Fred Prince
(74) *Attorney, Agent, or Firm* — JK Intellectual Property Law, PA

(57) ABSTRACT

A skimmer for removing water from a basin to an outlet conduit includes a buoyant element with a buoyancy sufficient that the skimmer will float generally at a surface of water within the basin; an inlet mounted to an underside of the buoyant element, the inlet pipe defining an inlet located within a perimeter of the buoyant element for receiving water to be transmitted to the outlet conduit; and a flexible membrane arranged circumferentially around the buoyant element. The flexible membrane side wall extends downward from the buoyant element to a position below the inlet, the flexible membrane configured to at least one of, filter water passing through the flexible membrane and redirect water to pass under the flexible membrane, to and through the inlet at a water flow rate. A related kit includes two skirts configured for use in different flow conditions.

28 Claims, 8 Drawing Sheets

(56) References Cited

U.S. PATENT DOCUMENTS

| | | | | |
|---|---|---|---|---|
| 6,251,286 | B1 * | 6/2001 | Gore | B01D 17/0214 210/776 |
| 6,436,289 | B1 * | 8/2002 | Johnstone | B65D 90/24 222/105 |
| 8,043,026 | B2 | 10/2011 | Moody | |
| 9,574,337 | B1 | 2/2017 | Lang et al. | |
| 2007/0251879 | A1 | 11/2007 | Batten et al. | |
| 2016/0053455 | A1 * | 2/2016 | Lundback | B01D 21/0003 210/242.1 |

FOREIGN PATENT DOCUMENTS

| | | |
|---|---|---|
| KR | 10-20090034526 | 4/2009 |
| KR | 10-20100082431 | 7/2010 |

OTHER PUBLICATIONS

Canadian Office Action for Application No. 2,949,117, dated Jul. 23, 2020.

* cited by examiner

SKIMMER WITH FLEXIBLE PERIPHERAL MEMBRANE, AND RELATED SKIMMER KIT WITH MULTIPLE FLEXIBLE PERIPHERAL MEMBRANES

CROSS-REFERENCE TO RELATED APPLICATION

The present application is a Non-Provisional patent application and claims priority to U.S. Provisional Patent Application Ser. No. 62/980,414, filed Feb. 23, 2020, which is incorporated by reference herein.

TECHNICAL FIELD

The present invention relates generally to water skimmers used to control the removal of water from water bodies, such as detention ponds, retention ponds, underground detention systems, and/or sediment basins.

BACKGROUND

Water flow rate control skimmers are used in storm water and erosion control applications to control the release of water in from a water body, such as detention ponds, retention ponds, underground detention systems, and/or sediment basins (all generically referred to as a "basin" herein). By collecting water and holding it for a time in such a basin, sediment can settle out at the bottom of the basin and generally cleaner water can be released. Floating skimmers release water from just below the basin's surface (where dispersed sediment is generally lower) to an adjacent area at a desired controlled rate, which may depend on many factors for a given basin. Drawing from just beneath the surface provides benefits such as avoiding release of floating materials found on the basin's water surface and releasing water with generally lower amounts of sediment than is found in water lower in the basin.

Various national, state, and local environmental regulations exist worldwide regarding such water collection and release. Often, there are different requirements for "during construction" installations (when the ground is more disturbed and sediment from disturbed ground running into the pond) is naturally higher and for permanent "post-construction" installations. Improved skimmer designs that meet current or future regulations, and/or that provide one or more benefits such as modularity, efficiency, reliability, cost effectiveness, and suitability for use with differing types and sizes of basins with differing stages and types of usage, and/or that meet any other known or unknown need or advantage, would be welcome.

SUMMARY

The following presents a simplified summary of the invention in order to provide a basic understanding of some aspects of the invention. This summary is not an extensive overview of the invention. It is not intended to identify key or critical elements of the invention or to delineate the scope of the invention; its sole purpose is to present concepts of the invention in a simplified form as a prelude to the more detailed description that is subsequently presented.

According to certain aspects of the disclosure, a skimmer for removing water from a basin to an outlet conduit may include a buoyant element with a buoyancy sufficient that the skimmer will float generally at a surface of water within the basin; a mount attached to the buoyant element; an inlet pipe mounted to an underside of the buoyant element via the mount, the inlet pipe defining an inlet located within a perimeter of the buoyant element for receiving water to be transmitted to the outlet conduit thereby removing water from the basin; and a flexible membrane arranged circumferentially around the buoyant element. The flexible membrane includes a side wall extending downward from the buoyant element to a position below the inlet, the flexible membrane configured to at least one of, filter water passing through the flexible membrane and redirect water to pass under the flexible membrane, to and through the inlet at a water flow rate. Various options and modifications are possible.

For example, the flexible membrane may include at least two layers arranged generally concentrically around the buoyant element. The flexible member may also include a fabric, such as one of a non-woven material or a woven material. The flexible membrane may also be wrapped around a perimeter of the buoyant element and is attached intermittently to the perimeter with joinder members. The flexible membrane may defines a bottom edge along a bottom of the side wall. The side wall and bottom edge may be configured so that the bottom edge defines an opening beneath the buoyant element and the inlet of the inlet pipe, and so that the side wall extends generally vertically downward from the buoyant element to the bottom edge. The bottom edge may be joined together to substantially enclose the buoyant element and the inlet pipe within an inner area of the flexible membrane. The bottom edge may be joined together by joinder elements spaced intermittently along the bottom edge.

The inlet pipe is mounted to the buoyant element via the mount such that the inlet pipe is pivotable relative to the buoyant element on a horizontal central axis extending along the inlet pipe.

The mount may include two flexible straps, each strap having two ends and a central portion, the two ends of the straps being attached to the buoyant element so that the inlet pipe is supported by the central portions. The inlet pipe may be attached to an outflow pipe extending from a center portion of the inlet pipe and in fluid communication with the outlet conduit, a flow constriction located along a flow path from the inlet of the inlet pipe to the outlet conduit, the flow constriction and not the flexible membrane defining the water flow rate from the inlet to the outflow pipe. The inlet pipe and the outflow pipe may meet in a perpendicular, t-shaped joint. The outflow pipe may extend through a passage located in a side wall of the flexible membrane. The flow constriction may be definable by an opening extending through a side wall of the inlet pipe in communication with the outlet pipe. The flow constriction may adjustable in size to alter the water flow rate. The inlet pipe may define a flow opening extending through a side wall of the inlet pipe in communication with the outlet pipe, the flow opening having a diameter, the skimmer further including a flow-adjusting member defining at least one adjustment opening having a diameter smaller than the diameter of the flow opening, the flow-adjusting member attachable to the interface so that the adjustment opening is aligned with the flow opening to reduce the water flow rate therethrough. The flow-adjusting member may have a least two adjustment openings of different diameters for allowing respective different flow rates through the flow opening, the flow-adjusting member including a flexible plate attachable to an interior of the inlet pipe in multiple orientations, each of the multiple orientations aligning a respective one of the adjustment openings with the flow opening for defining the water flow rate through the flow opening.

A vent tube may be provided extending upwardly from a first end in communication with an interior of the outflow pipe along the flow path through a central area of the buoyant element to a second end at a height above a top of the buoyant element for venting during flow of water through the orifice.

A screen may be located along an upper side of the inlet pipe covering the inlet, water passing through the screen before following flow path.

The outflow pipe may be connected via a flexible coupling to the outlet conduit, and a pipe may extend between the outflow pipe and the flexible coupling. At least one weight may be provided for adjusting a buoyancy of the skimmer, and may include two weights located at opposite ends of the inlet pipe with the inlet being located between the two weights.

According to other aspects of the disclosure, a kit for a skimmer for removing water from a basin to an outlet conduit may include a buoyant element with a buoyancy sufficient that the skimmer will float generally at a surface of water within the basin; a mount attached to the buoyant element; an inlet pipe mounted to an underside of the buoyant element via the mount, the inlet pipe defining an inlet located within a perimeter of the buoyant element for receiving water to be transmitted to the outlet conduit thereby removing water from the basin; a first flexible membrane attachable circumferentially around the buoyant element and having a side wall extending downward to a position below the inlet, the first flexible membrane configured for use during a first condition; and a second flexible membrane attachable circumferentially around the buoyant element and having a side wall extending downward to a position below the inlet, the first flexible membrane configured for use during a second condition. Various options and modifications are possible.

For example, the inlet pipe may be attached to an outflow pipe extending from a center portion of the inlet pipe and in fluid communication with the outlet conduit, a flow constriction located along a flow path from the inlet of the inlet pipe to the outlet conduit, the first flexible membrane configured to redirect water to pass under the first flexible membrane to and through the inlet, the second flexible membrane configured to filter water passing through the second flexible membrane to and through the inlet, the constriction and not either of the first flexible membrane or the second flexible membrane defining the water flow rate from the inlet to the outflow pipe.

The first flexible membrane may include a woven fabric and the second flexible membrane may include a non-woven fabric. The first flexible membrane and the second flexible membrane may be selectively attachable to the buoyant element by wrapping around a perimeter of the buoyant element and being attached intermittently to the perimeter with joinder members.

The first flexible membrane side wall may be substantially annular and defines a bottom edge along a bottom of the side wall, the side wall and bottom edge being configured so that the bottom edge defines an opening beneath the buoyant element and the inlet of the inlet pipe.

The second flexible membrane side wall may defines a bottom edge that is joined together to substantially enclose the buoyant element and the inlet pipe within an inner area of the second flexible membrane. The bottom edge may be joined together by joinder elements spaced intermittently along the bottom edge.

The second flexible membrane includes at least two layers arranged generally concentrically around the buoyant element.

The inlet pipe may be mounted to the buoyant element via the mount such that the inlet pipe is pivotable relative to the buoyant element on a horizontal central axis extending along the inlet pipe, the inlet pipe being attached to an outflow pipe extending from a center portion of the inlet pipe and in fluid communication with the outlet conduit, a flow constriction located along a flow path from the inlet of the inlet pipe to the outlet conduit, the flow constriction and not the first flexible membrane or the second flexible membrane defining the water flow rate from the inlet to the outflow pipe. The outflow pipe may be extendable through a passage located in a side wall of the first flexible membrane or the second flexible membrane.

The flow constriction is adjustable in size to alter the water flow rate.

A vent tube may be provided extending upwardly from a first end in communication with an interior of the outflow pipe along the flow path through a central area of the buoyant element to a second end at a height above a top of the buoyant element for venting during flow of water through the orifice.

A screen may be located along an upper side of the inlet pipe covering the inlet, water passing through the screen before following flow path.

At least one weight may be located within the inlet pipe for adjusting a buoyancy of the skimmer.

Other features and their advantages will be readily apparent to those skilled in the arts, techniques and equipment relevant to the present invention from a careful reading of the Detailed Description, accompanied by the following drawings.

DETAILED DESCRIPTION

The present invention includes methods and apparatuses relating to water skimmers for use in removing water from a sediment basin, wastewater lagoon or pond. As noted above, "basins" or "sediment basins," be used generically to refer to ponds and any small body of water, man-made or otherwise, engineered or natural, that receives runoff from its immediate surroundings, are used to sediment produced by heavy rainfall from adversely affecting the vicinity. These may also include wastewater lagoons, retention ponds, detention ponds, and other structures. Sediment basins are used in connection with a water removal system which is any structure or land configuration that receives water from the sediment basin and redistributes it to that water removal system, preferably leaving sediment behind. Thus, it should be understood that no limitation is intended to be made of use of the disclosed skimmers and related parts with any particular type of "basin."

Figure 5:
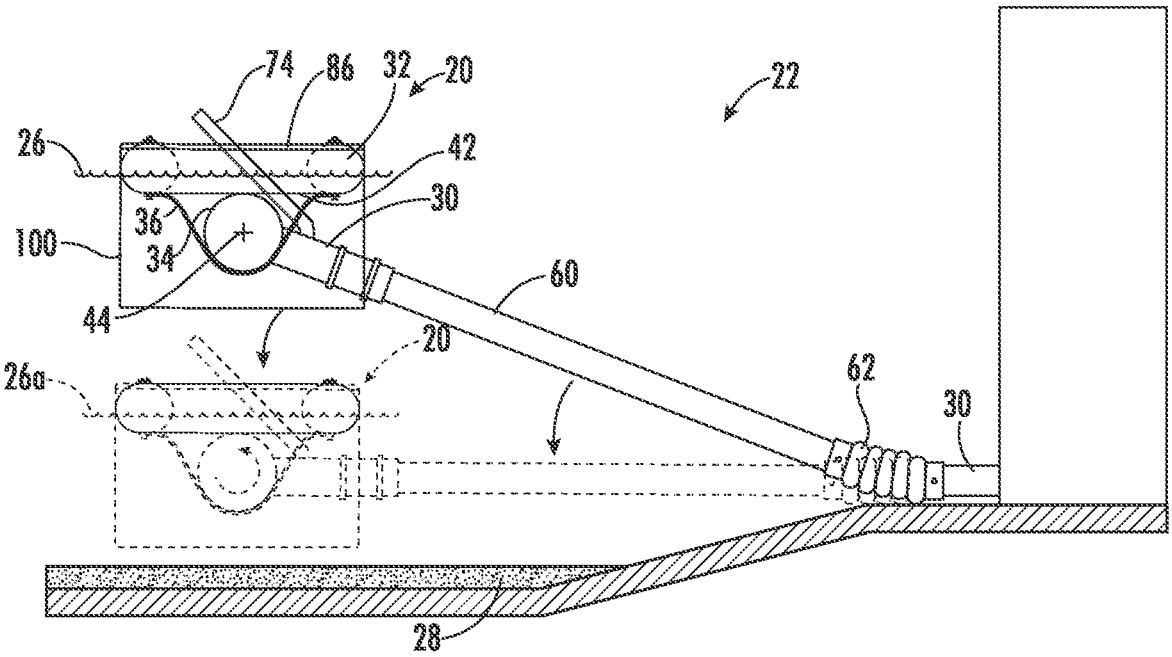
FIG. 5 is a side diagrammatic view showing the skimmer as in FIG. 1 or 2 at different water levels in a basin.
Figure 6:
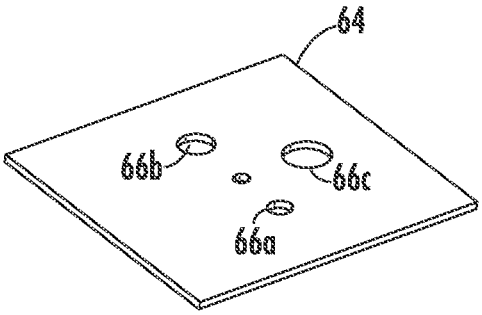
FIG. 6 is an isometric view of a flow-adjusting member usable with the skimmers as in FIG. 1 or 2.
Figure 7:
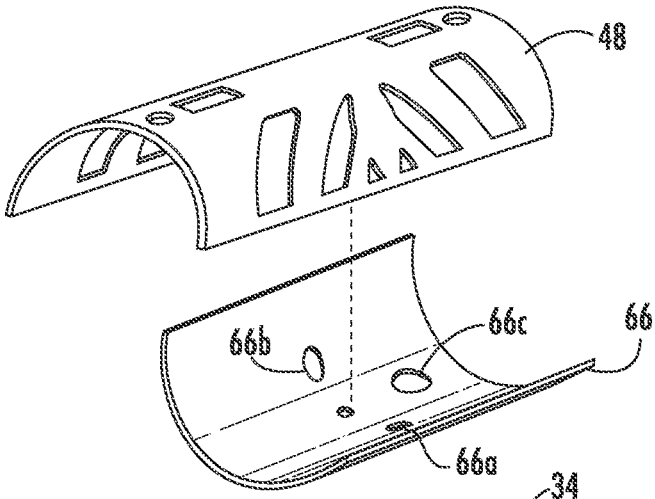
FIG. 7 is an exploded enlarged isometric view showing alignment of the screen and the flow-adjusting member to the remainder of the skimmer.
Figure 7:
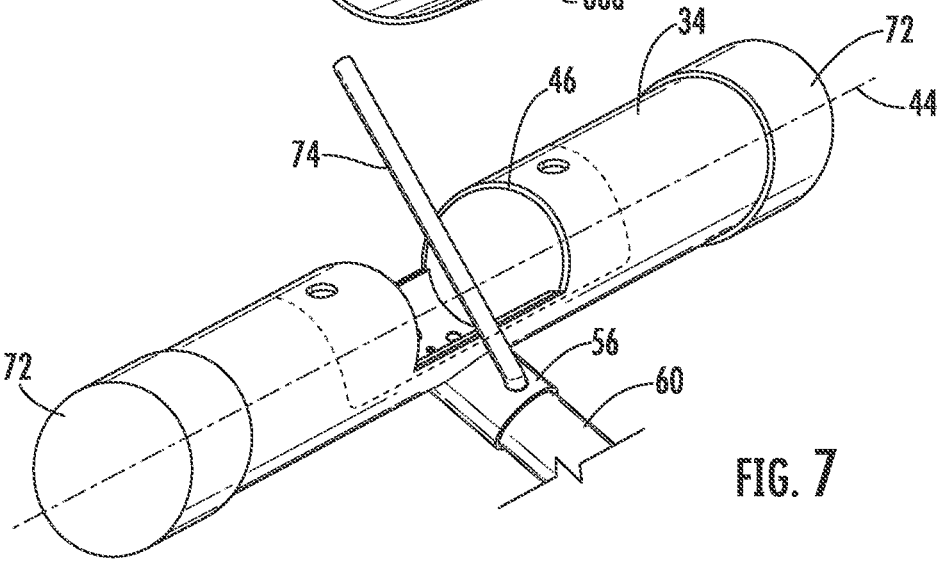
Figure 8:
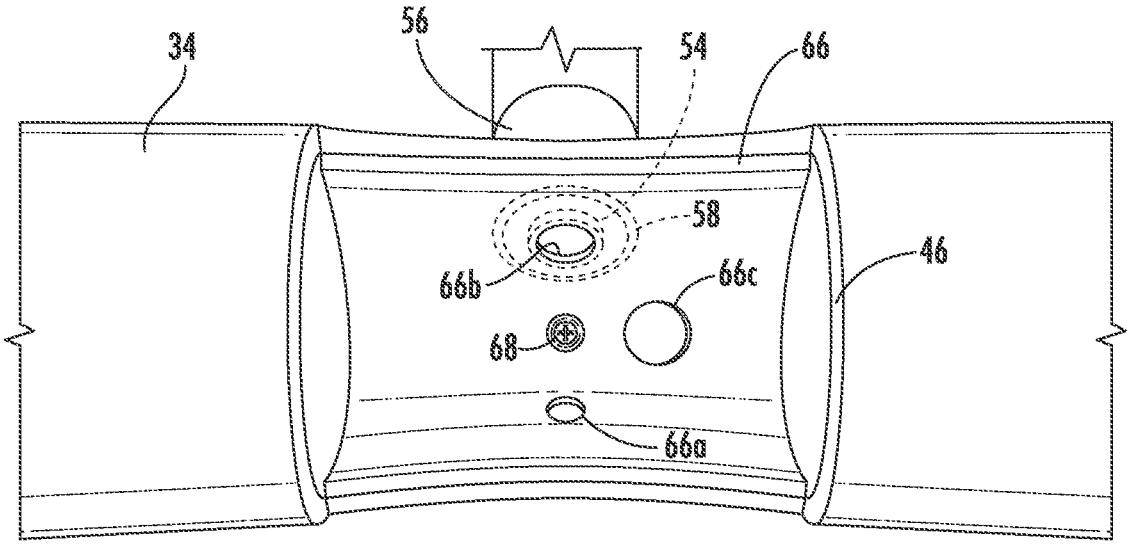
FIG. 8 is an enlarged isometric view showing attachment of the flow-adjusting member to the remainder of the skimmer in one flow-adjusting orientation.

FIGS. 1-13A show skimmer 20 with differing surrounding membranes, as installable in a basin 22 (FIG. 5). Basin 22 as generically illustrated receives a flow of water 24 having a top surface 26 above a bottom 28 of basin 22. Top surface 26 rises and falls (see also surface 26*a*, discussed below) as flow enters basin 22 and drains from basin, typically occurring at differing rates. By holding collected water 24 in basin 22 for a period of time, at least some of the sediment carried by water 24 flowing into basin 22 will tend to settle out over time and fall to bottom 28, leaving water nearer surface 26 relatively cleaner than water nearer bottom 28. Accordingly, water 24 that is collected by skimmer 20 near the surface and transferred out of basin through an outlet conduit 30 nearer bottom 28 will generally have less sediment than if removed directly near outlet conduit 30. It should be understood that illustrated basin 22 is but one example of an application of skimmer 20 according to the present disclosure, and one skilled in the art would understand applicability to other types and proportions of installations than basin 22 as illustrated.

Skimmer 20 is provided a desired buoyancy by buoyant element 32, which as configured includes a buoyant ring. If required, buoyant element 32 could employ multiple of such rings, or a single "ring" could have other dimensions or shapes (e.g., a perimeter not circular, a different cross-sectional shape, etc.). If used with flexible membranes as discussed below, buoyant element 32 need not necessarily define a continuous 360 degree structure or perimeter at the water surface 26; the flexible membrane may substantially perform that function. Thus, buoyant element 32 can have various shapes besides that shown. The choice of buoyant element design is a question of the weight to be supported by buoyant element 32 needed to counteract the buoyancy of remainder of skimmer 20 and connected elements, which may require a modest amount of experimentation and calculation within the level of ordinary skill of a professional engineer. Buoyant element 32 may be made of polyethylene or high density polyethylene for longevity in a wet and sun-lit environment. FIG. 5 also shows skimmer 20 floating on a lower water surface 26*a* in phantom lines to illustrate where skimmer 20 would be if the amount of water 24 were reduced.

An inlet pipe 34 is mounted to an underside 42 of buoyant element 32 via a mount, which may be, for example, strips 36 of HDPE. Bolts 38 and nuts 40 may be used to fasten strips 36 at their ends with inlet pipe 34 held in a lower central area therebetween. Strips 36 should be configured to hold inlet pipe 34 against bottom surface 42 of buoyant element 32 while still allowing inlet pipe 34 to rotate about its longitudinal (horizontal) axis 44 relative to the strips and the buoyant element.

Inlet pipe 34 defines an inlet 46 located within a perimeter of the buoyant element 32 (see FIG. 4) for receiving the water to be transmitted to the outlet conduit 30. As illustrated, inlet 46 is a generally rectangular opening cut out of the upper circumference of inlet pipe 34. Inlet 46 may be covered by a screen 48 attached to inlet pipe 34 by fasteners, such as screws 50 and washers. Screen 48 may have a number of openings as illustrated or may be a finer mesh to allow generally unimpeded flow of water therethrough, while preventing floating debris of a certain size from passing through the screen openings/mesh. A flow opening 54 in a side wall of inlet pipe 34 leads to outflow pipe 56 rigidly fixed to the inlet pipe and having a diameter 58 adjacent flow opening 54 which may be as large as or larger than opening 54, as will be discussed below.

Outflow pipe 56 may be attached directly or via a pipe coupling (not shown) to additional piping 60 (one or more joined pipes) leading eventually to outlet conduit 30. A flexible coupling 62 may be provided at some point between outlet conduit 30 and some or all of the additional piping 60 to allow some or all of the additional piping, and the connected skimmer inlet pipe 34 and outflow pipe 56, to pivot relative to buoyant element 32, strips 36, and other parts connected thereto as water level rises or falls within basin 22, the skimmer floating on water surface 26.

To define a flow rate, a flow constriction may be located along a flow path from inlet 46 of inlet pipe 34 through outflow pipe 56 to outlet conduit 30. As shown, inlet pipe 34 and outflow pipe 56 meet in a perpendicular, t-shaped joint. The flow constriction may be defined by opening 54 extending through the side wall of inlet pipe 34. As noted, opening 54 may be smaller than or as large as diameter 58 of outflow pipe 58.

If desired, the flow constriction may be selectively defined by one or more additional orifices, openings, flow restrictions, etc., located elsewhere along the flow path, in order to alter the water flow rate out of basin 22 to a desired rate. One or more flow-adjusting members 64, which may be a flexible plate made of a polymer or rubber, may provide selective flow adjustment. Flow adjusting member 64 is attachable to inlet pipe 34 adjacent flow opening 54 to potentially modify the effective diameter of flow opening (thereby acting as the flow constriction). As shown, three openings 66*a*-*c* of differing sizes extend through member 64. By rotating member 64 relative to inlet pipe 34, a desired one of openings 66*a*-*c* may be aligned with flow opening 54. Openings 66*a*-*c* may all be smaller than flow opening 54, or one of openings 66*a*-*c* may be the same size, if desired, in which case no further flow constriction is caused but member 64 is reliably stored in inlet pipe 34 for potential future realignment. Flow adjusting member 64 may be secured in inlet pipe 32 in any desired way, such as one or more fasteners 68, or snaps, clips, slots, etc. Member 64 may also comprise more than one part removably attachable, with each part having a differently sized opening, and/or member(s) may be located in other locations, such as in outflow pipe 56 or the coupling between outflow pipe and inlet pipe 32, or other locations along the flow path. The location within inlet pipe 34 is a convenient but not required location.

If desired to maintain buoyancy of skimmer 20 at a desired level, as well as to maintain inlet 46 of inlet pipe 34 below surface 26, weight may be provided for skimmer 20. Thus, at least one weight may be provided in a central location, or more preferably, two weights 70 may be provided within opposite ends of inlet pipe, so as to not block flow through inlet 46. Weights may be any suitable material of desired weight and density, such as sand, gravel, cement, lead, water, etc. Weights 70 may themselves provide an inner wall facing inlet 46, or a wall may be provided there (not shown) to confine weight 70 in place, per choice of the designer. Caps 72 on ends of inlet pipe 34 may be permanently or removably attached to hold weights 70 in inlet pipe, and weights may be changed out to change buoyancy per a given application or in case buoyant element 32 is also changed to provide a modularity and selectability of sizes and characteristics of parts of skimmer 20.

A vent tube 74 may be provided extending upwardly from a first end 76 in communication with an interior of outflow pipe 56 (or local coupling) along the flow path through a central area 78 of buoyant element 32 to a second end 80 at a height above a top of the buoyant element for venting during flow of water through flow opening 54. Such venting ensures flow from inlet 46 along the flow path to outlet conduit 30 is dictated by gravity, orientation of the various parts in the flow path, the flow constriction, opening and orifice sizes, etc., and not due to any siphoning or suction effect created once flow begins.

According to certain aspects of the disclosure one or more flexible membranes may be employed as part of or with the above skimmer 20. Membranes having different constructions or characteristics may be provided in a kit, along with a single buoyant element 32/inlet pipe 34/outflow pipe 56 unit, so that the membranes can be changed out for different types of use of the skimmer.

Figure 1:
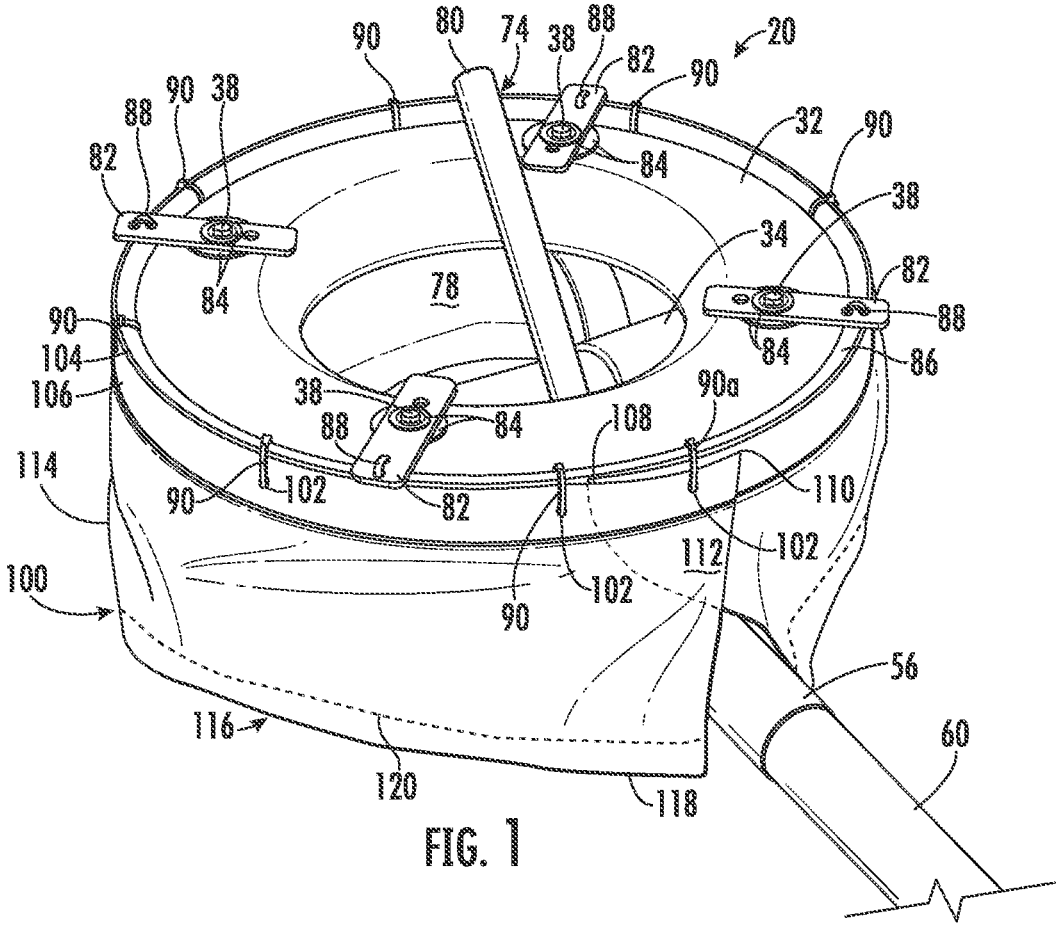
FIG. 1 is an isometric view of an embodiment of a skimmer with a first flexible membrane attached.
Figure 2:
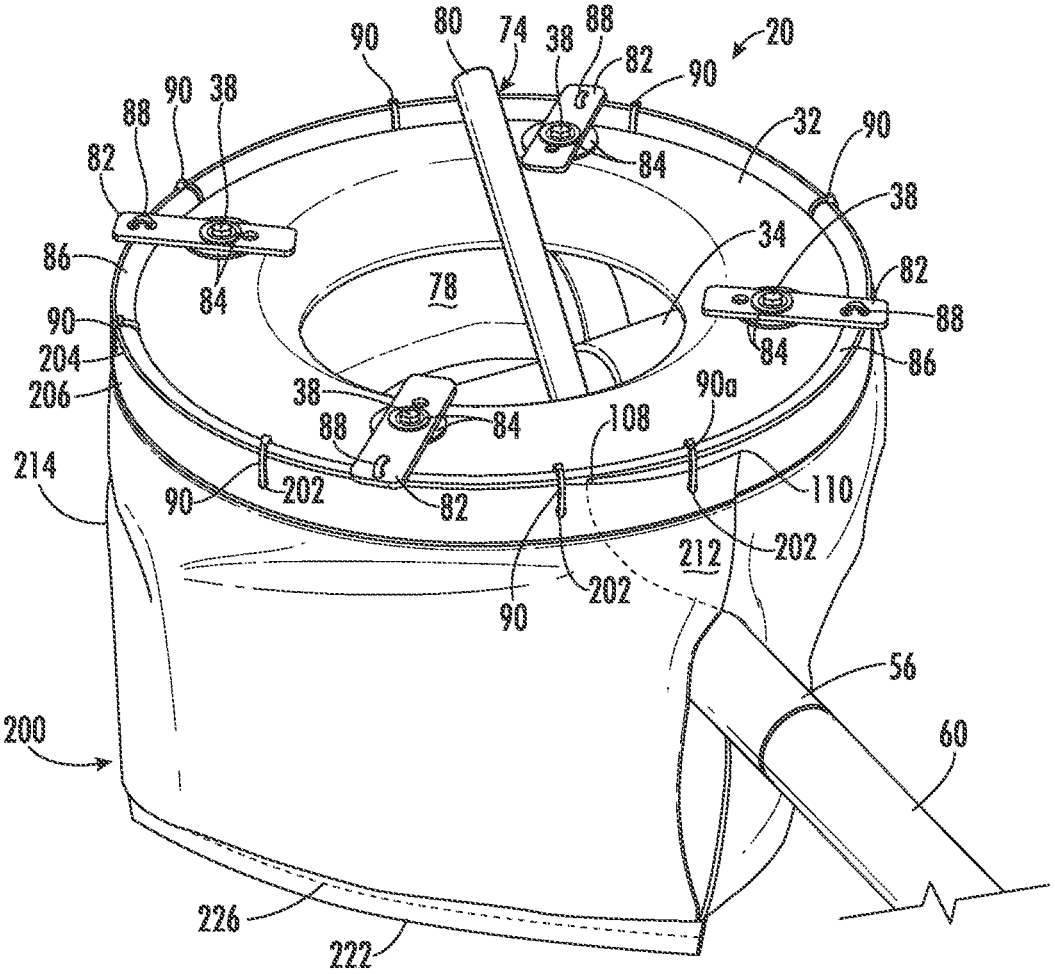
FIG. 2 is an isometric view of the skimmer as in FIG. 1 with a second flexible membrane attached.
Figure 3A:
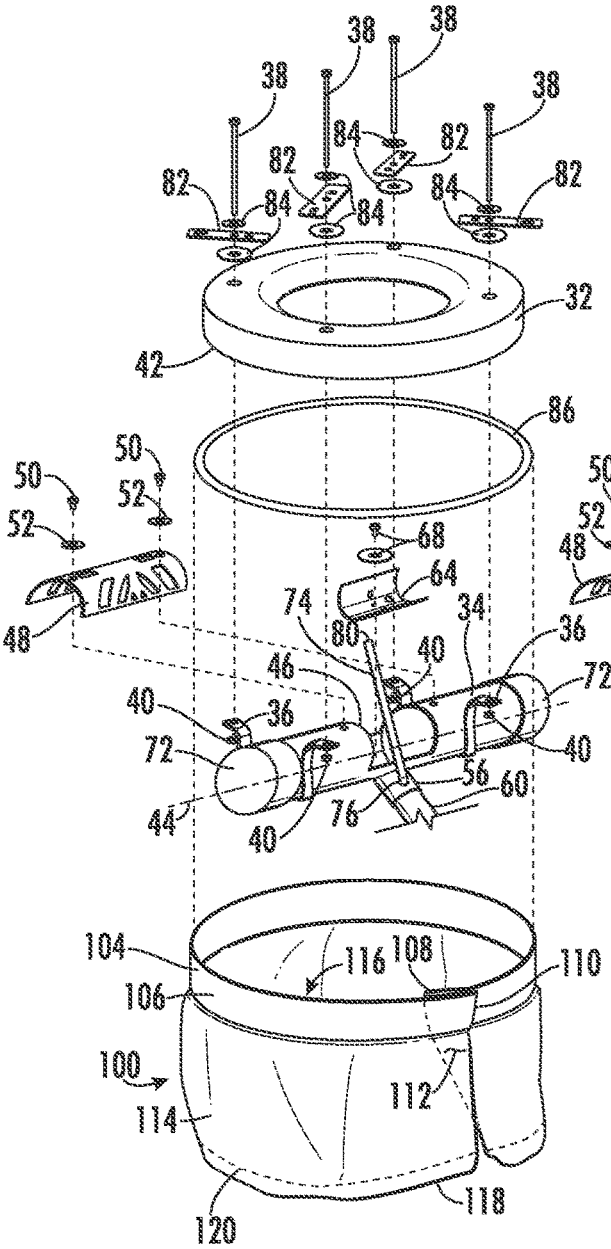
FIG. 3A is an exploded isometric view as in FIG. 1.
Figure 3B:
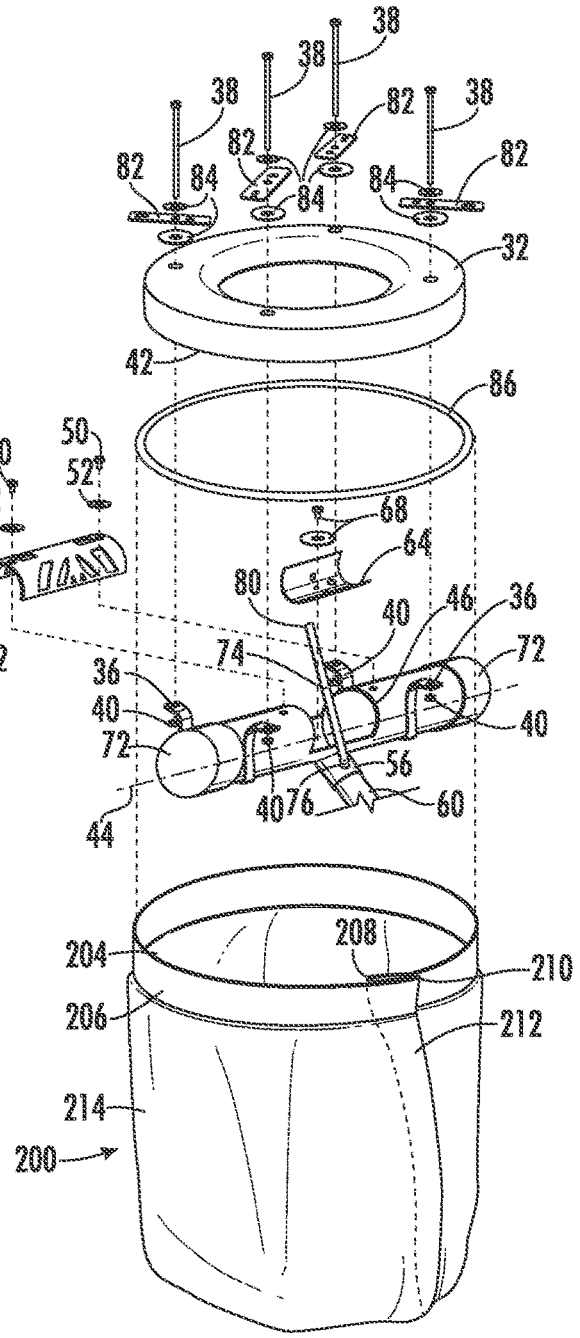
FIG. 3B is an exploded isometric view as in FIG. 2.
Figure 4:
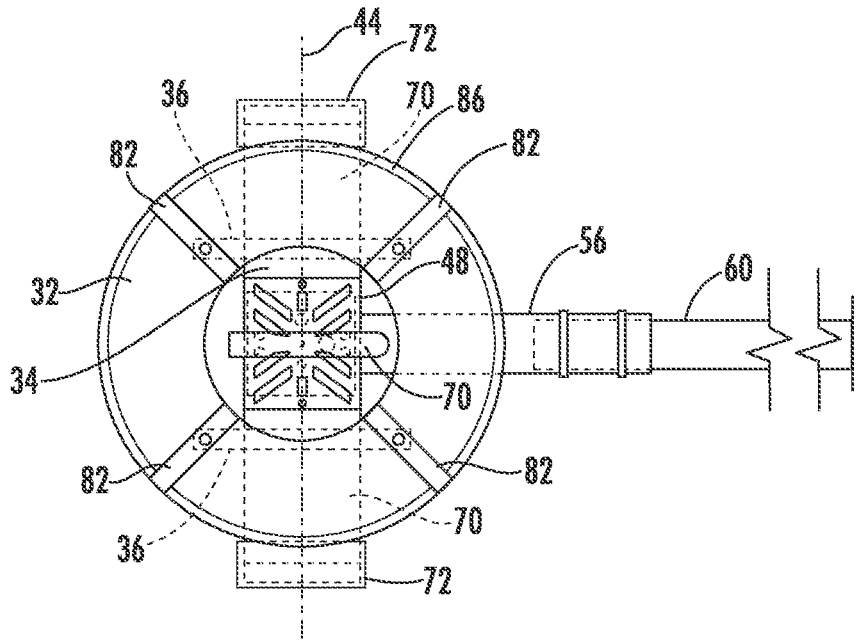
FIG. 4 is a top view of the skimmer as in FIG. 1 or 2 without the flexible membranes.

FIGS. 1 and 3A show a first membrane 100 for use during a first condition (e.g., during-construction use), and FIGS. 2, 3B, and 9A-13B show a second membrane 200 for use during a second condition (e.g., post-construction, "typical" retention pond use). Each of the membranes 100,200 may be a single layer or multiple layer fabric wrapped around a circumference of skimmer 20, in particular at least as high was around buoyant element 32 above the water surface 26 when the skimmer floating.

Each flexible membrane 100,200 may be attached to skimmer 20 in various ways. As shown, hardware such as bars 82 centered between locating washers 84 on bolts 38 may be employed to hold a mounting ring 86 via fasteners 88, such as zip ties, clips, snaps, screws, or the like. Openings 102,202 distributed around top ends 104,204 of flexible membranes 100,200 may be used to attach the flexible membranes to skimmer 20, for example to ring 86 using fasteners 90, again such as zip ties, clips, snaps, screws, or the like. Ring 86 may be considered or provided either as a part of skimmer 20 and/or buoyant element 32, or as part of or with flexible membranes 100,200. Reinforcement such as a reinforcement strip 106,206, and/or metal eyelets, stitching, etc., may be provided on the flexible membranes 100,200 to ensure fasteners 90 reliably hold them in place, do not tear, etc.

As illustrated, flexible membranes 100,200 may be readily attached using zip ties 90 through openings 102,202, starting at a first end 108,208 and proceeding circumferentially to a second end 110,210 with an overlap area 112,212 in which at least one of the zip ties 90*a* extends through both ends. Other methods and structures could be employed to achieve such a circumferential wrap.

The disclosed attachment structure and arrangements could be modified, for example by providing structures on buoyant element for direct attachment to flexible membranes 100,200. Such structures could be straps, clips, snaps, protrusions, cooperating structures, hook and loop fasteners, hardware fasteners of any type, etc., so as to hold flexible membranes 100,200 around buoyant element 32 or other skimmer structure high enough to be above the water surface 26 (so that water cannot pass over flexible membranes 100,200 on the way to inlet 46).

Flexible membranes 100,200 each include a side wall 114,214 extending downward from the top ends 104,204 adjacent the buoyant elements 32 to a position below the inlet 46. Outflow pipe 56 and or additional piping 60 may extend between ends 108,110 and 208,210 of side wall 114,214 below tops 104,204 of the flexible membranes, essentially by pulling aside the overlap to let the pipes pass from within the flexible membranes to outside of the flexible membranes. If desired for additional flow control of filtering function, a closure, gather, etc. (not shown) could be provided to hold flexible membranes 100,200 closely around such pipes at the transition point.

Depending on the material used and particular structure, each flexible membrane may at least one of, filter water passing through the flexible membrane and/or redirect water to pass under the flexible membrane. Preferably, whichever route or mode the water takes, the flexible membranes are not the limiting factor controlling and/or reducing flow rate using skimmer 20; instead, the flow constriction, opening sizes, etc., along the flow path control the flow rate.

In other words, flow around and or though the flexible membranes 100,200 should be at least as high as the flow rate through the rest of skimmer 20. More preferably, the flow possible through and/or around the flexible membranes may be several times, or least five times, or even as high as ten times as high, as such skimmer flow rate. Thus, the hydraulic calculations used to define flow rate, opening size, flow constriction are still valid, even if the flexible membranes also filter and/or re-direct flow to an extent. Such may be important, for example, if after installation the flexible membrane transmissivity might become reduced because the membranes have become clogged, dirty, etc., in use. Choosing the flexible membrane for initial transmissivity much higher (several times higher, five times higher, ten times higher, etc.) than the skimmer's throughput, taking into account the range of adjustable flow constrictions that might be used, ensures reliable and predictable basin drainage per desired parameters.

Use of a flexible membrane as opposed to a rigid structure to surround and direct flow allows one or more benefits. For example, the membrane can collapse onto itself allowing the skimmer to sit lower in an empty or nearly empty basin, so flow out can start sooner. Also, lack of rigidity provides a more stable skimmer with a lower center of gravity when sitting on a low or empty basin. No interference between a rigid guard and the outlet pipe is present, which could topple or misalign the skimmer in some orientations. And filtration is possible with flexible membranes that allow transmissivity where rigid guards cannot provide such feature. Filtration assists with reducing sediment content in outflow even further than simply allowing the sediment to settle out. Thus, better performance (cleaner outflow) may be possible for certain basins, and smaller basins may be able to be used to support a certain amount of acreage if filtration supplements settling.

By way of non-limiting example, depending on basin height and size of skimmer, for example, flow rates out of the skimmer may be on the order of from about 0.2 to about 0.9 cfs. Flexible membranes transmissivity or bypass rates should preferably be several times that to ensure the skimmer operates at a flow of desired parameters and not something undesirably less.

Flexible membrane 100 of FIG. 1 is essentially annular, defining an opening 116 around a bottom edge 118. Reinforcement 120 such as stitching or a reinforcement strip may be used to reinforce the bottom edge. Flexible membrane 100 may be a woven or unwoven material of one or more layers, or a combination of such materials. If woven, the material may be a woven geotextile fabric made of a polypropylene slit-film tapes. If non-woven, the material may be a non-woven such as Ultra-X-Tex® fabric available from Ultratech Intl Inc., selected so as to provide desired flow, or other filtering non-woven geotextile with sufficient flow properties. Flexible membrane may redirect and/or filter flow, and may favor one over the other depending on the material chosen, skimmer design, etc. Membrane 100 may lend itself to first condition (during-construction use) where higher flow may be desired around and not so much through the membrane.

Flexible membrane 200 as illustrated is a two-layer membrane, with each layer gathered together along bottom edges by joinder elements such as snaps, staples, zip ties etc. Membrane 200 could be a single layer as well, as will be discussed blow.

FIGS. 9A-13B are instructive on how such two-layer, second flexible membrane 200 can be made.

Figure 9A:
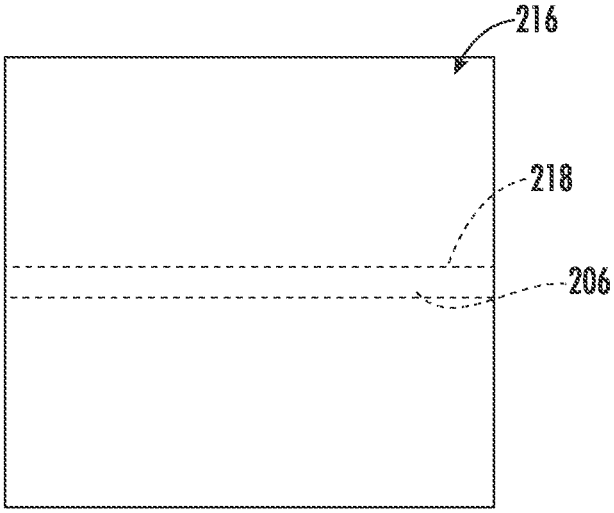
FIGS. 9A and 9B are front and side views showing an initial orientation of the material in a method of forming a two-layer flexible membrane.
Figure 9B:
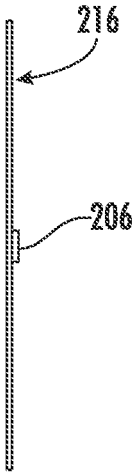

FIGS. 9A and 9B show sheet 216 with a horizontal fold line 218 just above (optional) reinforcing strip 206.

Figure 10A:
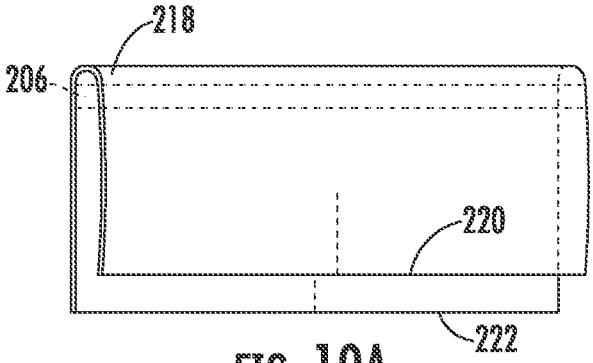
FIGS. 10A and 10B are front and side views showing a second orientation of the material after horizontal folding to form an inner layer and an outer layer.
Figure 10B:
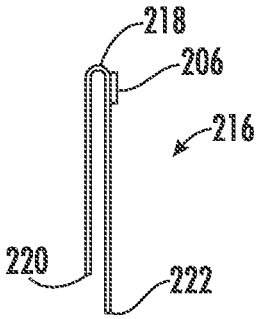

In FIGS. 10A and 10B, sheet 216 has been folded on line 218. Note that inner edge 220 is shorter than outer edge 222.

Figure 11A:
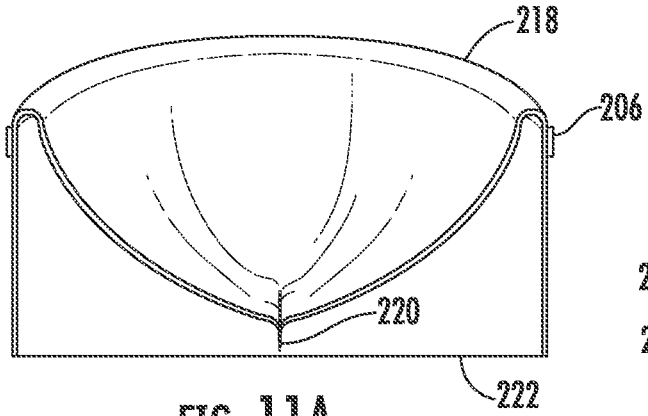
FIGS. 11A and 11B are front and side views showing a third orientation of the material after gathering and joinder of the bottom edge of the inner (shorter) layer.
Figure 11B:
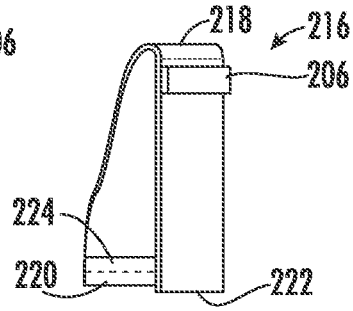

In FIGS. 11A and 11B, sheet 216 has been curved a bit so that the sheet portion above the shorter inner edge 220 folds around a vertical line and inner edge 220 is joined to itself from end to end by joinder members 224 such as staples, stitches, etc.

Figure 12A:
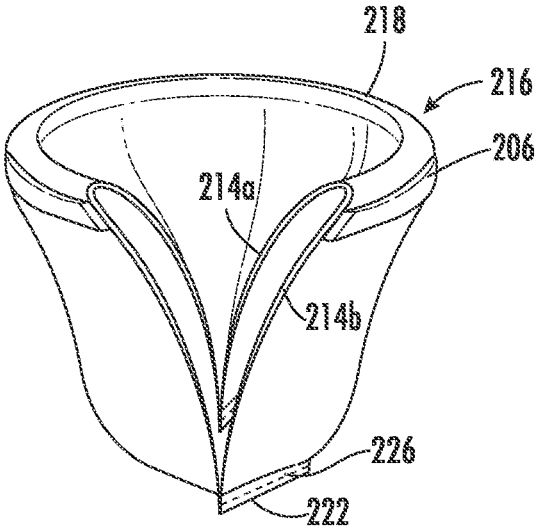
FIGS. 12A and 12B are front and side views showing a fourth orientation of the material after gathering and joinder of the bottom edge of the outer (longer) layer.
Figure 12B:
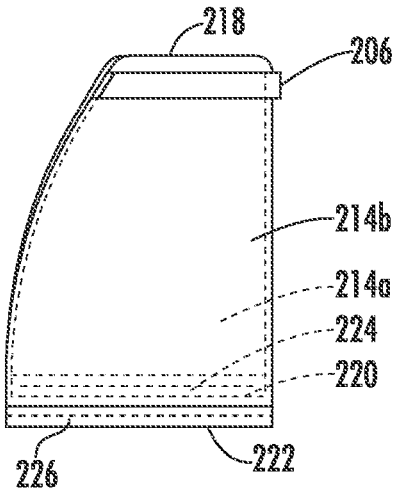

In FIGS. 12A and 12B, the process is repeated for the sheet portion above the longer outer edge 222 to create a second joinder using joinder members 226. Side wall 214 of second membrane 200 is thus formed of two parts: inner side wall 214*a* and outer side wall 214*b*, respectively from the bottom edges 220,222 up to the fold line 218.

Figure 13A:
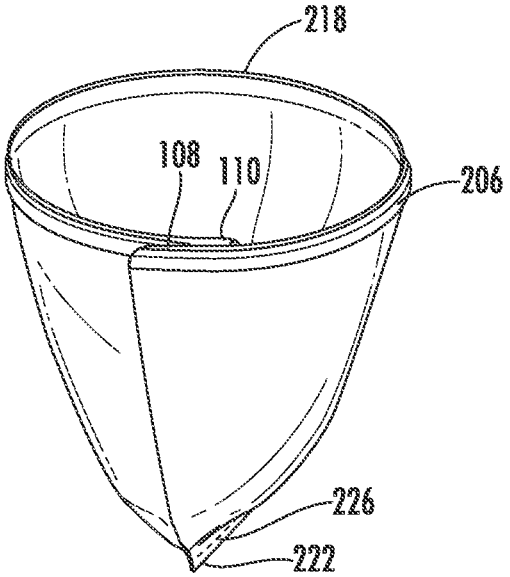
FIGS. 13A and 13B are front and side views showing a fifth orientation of the material after overlapping of the top (folded) edge of the material, as would be done about the buoyant element of the skimmer.
Figure 13B:
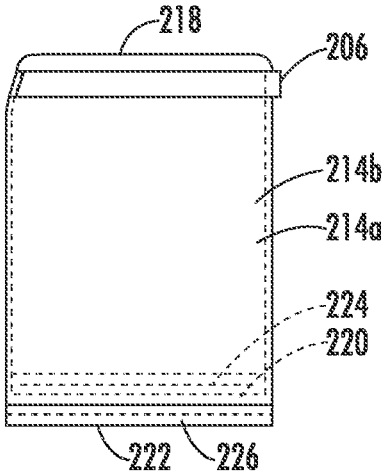

FIGS. 13A and 13B show how second flexible membrane 200 can be wrapped around skimmer 20 to create the double-walled filter structure.

It should be understood that the first step could be skipped, and a single walled structure with closed bottom edges could be used, if desired. Alternatively, two separate single walled (closed and/or unclosed) structures could be employed at once instead of starting with the first horizontal folding step. An outer open structure could be used with an inner closed structure, and/or inner and outer structures may be made of different materials with different properties, if desired. Thus, one layer could be woven and one non-woven, if desired. The joinder members at the bottom edges may be spaced laterally and/or connected loosely enough to allow some downward flow therebetween, in particular to allow for filtered sediment or other debris to fall downwardly out of the membrane rather than to pass out of the basin in the flow.

Thus, the various options and different flexible membranes noted above, with all their respective possible options and modifications, can be said to be used in a kit for a skimmer for removing water from a basin to an outlet conduit, wherein a first flexible membrane is attachable circumferentially around the buoyant element configured for use during a first condition, and a second flexible membrane attachable circumferentially around the buoyant element configured for use during a second condition. Such a kit and system provides improved functionality, as noted above, and also provides modularity where fewer skimmer parts may be required for a lifespan of a project from construction to afterwards, and function can be changed when needed by changing out the flexible membrane and/or changing the flow constriction (e.g., the orientation or placement of the flow adjusting member)

Other features and their advantages will be readily apparent to those skilled in the arts, techniques and equipment relevant to the present invention from a careful reading of the Detailed Description, accompanied by the following drawings.

Those skilled in the relevant arts will appreciate from the foregoing description of preferred embodiments that substitutions and modification can be made without departing from the spirit and scope of the invention which is defined by the appended claims.

I claim:

1. A skimmer for removing water from a basin to an outlet conduit, the skimmer comprising:

a buoyant element with a buoyancy sufficient that the skimmer will float generally at a surface of water within the basin;

a mount attached to the buoyant element;

an inlet pipe mounted to an underside of the buoyant element via the mount, the inlet pipe defining an inlet located within a perimeter of the buoyant element for receiving water to be transmitted to the outlet conduit thereby removing water from the basin; and a flexible membrane arranged circumferentially around the buoyant element, the flexible membrane including a side wall extending downward from the buoyant element to a position below the inlet, the flexible membrane configured to at least one of, filter water passing through the flexible membrane and redirect water to pass under the flexible membrane, to and through the inlet at a water flow rate.

2. The skimmer of claim 1, wherein the flexible membrane includes at least two layers arranged generally concentrically around the buoyant element.

3. The skimmer of claim 1, wherein the flexible member includes a fabric.

4. The skimmer of claim 1, wherein the flexible membrane is wrapped around a perimeter of the buoyant element and is attached intermittently to the perimeter with joinder members.

5. The skimmer of claim 1, wherein the flexible membrane defines a bottom edge along a bottom of the side wall of the flexible membrane.

6. The skimmer of claim 5, wherein the side wall and bottom edge of the flexible membrane are configured so that the bottom edge defines an opening beneath the buoyant element and the inlet of the inlet pipe.

7. The skimmer of claim 6, wherein the side wall of the flexible membrane extends generally vertically downward from the buoyant element to the bottom edge.

8. The skimmer of claim 5, wherein the bottom edge is joined together to enclose the buoyant element and the inlet of the inlet pipe within an inner area of the flexible membrane.

9. The skimmer of claim 1, wherein the inlet pipe is mounted to the buoyant element via the mount such that the inlet pipe is pivotable relative to the buoyant element on a horizontal central axis extending along the inlet pipe.

10. The skimmer of claim 9, wherein the inlet pipe is attached to an outflow pipe extending from a center portion of the inlet pipe and in fluid communication with the outlet conduit, a flow constriction located along a flow path from the inlet of the inlet pipe to the outlet conduit, the flow constriction and not the flexible membrane defining the water flow rate from the inlet to the outflow pipe.

11. The skimmer of claim 10, wherein the inlet pipe and the outflow pipe meet in a perpendicular, t-shaped joint.

12. The skimmer of claim 10, wherein the outflow pipe extends through a passage located in a side wall of the flexible membrane.

13. The skimmer of claim 10, wherein the flow constriction is definable by an opening extending through a side wall of the inlet pipe in communication with the outlet pipe.

14. The skimmer of claim 10, wherein the flow constriction is adjustable in size to alter the water flow rate.

15. The skimmer of claim 14, wherein the inlet pipe defines a flow opening extending through a side wall of the inlet pipe in communication with the outlet pipe, the flow opening having a diameter, and further including a flow-adjusting member defining at least one adjustment opening having a diameter smaller than the diameter of the flow opening, the flow-adjusting member attachable to the inlet pipe so that the at least one adjustment opening is aligned with the flow opening to reduce the water flow rate therethrough.

16. The skimmer of claim 15, wherein the flow-adjusting member has a least two adjustment openings of different diameters for allowing respective different flow rates through the flow opening, the flow-adjusting member including a flexible plate attachable to an interior of the inlet pipe in multiple orientations, each of the multiple orientations aligning a respective one of the at least two adjustment openings with the flow opening for defining the water flow rate through the flow opening.

17. The skimmer of claim 1, further including at least one weight for adjusting a buoyancy of the skimmer.

18. A skimmer kit for removing water from a basin to an outlet conduit, the skimmer kit comprising:

a skimmer including:

a buoyant element with a buoyancy sufficient that the skimmer will float generally at a surface of water within the basin;

a mount attached to the buoyant element; and an inlet pipe mounted to an underside of the buoyant element via the mount, the inlet pipe defining an inlet located within a perimeter of the buoyant element for receiving water to be transmitted to the outlet conduit thereby removing water from the basin;

a first flexible membrane attachable circumferentially around the buoyant element and having a first flexible membrane side wall extending downward to a position below the inlet, the first flexible membrane configured for use during a first condition; and a second flexible membrane attachable circumferentially around the buoyant element and having a second flexible membrane side wall extending downward to a position below the inlet, the second flexible membrane configured for use during a second condition different than the first condition.

19. The kit of claim 18, wherein the inlet pipe is attached to an outflow pipe extending from a center portion of the inlet pipe and in fluid communication with the outlet conduit, a flow constriction located along a flow path from the inlet of the inlet pipe to the outlet conduit, the first flexible membrane configured to redirect water to pass under the first flexible membrane to and through the inlet, the second flexible membrane configured to filter water passing through the second flexible membrane to and through the inlet, the constriction and not either of the first flexible membrane or the second flexible membrane defining the water flow rate from the inlet to the outflow pipe.

20. The kit of claim 18, wherein the first flexible membrane includes a woven fabric and the second flexible membrane includes a non-woven fabric.

21. The kit of claim 18, wherein the first flexible membrane and the second flexible membrane are selectively attachable to the buoyant element by wrapping around a perimeter of the buoyant element and being attached intermittently to the perimeter with joinder members.

22. The kit of claim 18, wherein the first flexible membrane side wall is substantially annular and defines a bottom edge along a bottom of the first flexible membrane side wall, the first flexible membrane side wall and bottom edge being configured so that the bottom edge defines an opening beneath the buoyant element and the inlet of the inlet pipe.

23. The kit of claim 18, wherein second flexible membrane side wall defines a bottom edge that is joined together to substantially enclose the buoyant element and the inlet of the inlet pipe within an inner area of the second flexible membrane.

24. The kit of claim 18, wherein the second flexible membrane includes at least two layers arranged generally concentrically around the buoyant element.

25. The kit of claim 18, wherein the inlet pipe is mounted to the buoyant element via the mount such that the inlet pipe is pivotable relative to the buoyant element on a horizontal central axis extending along the inlet pipe, the inlet pipe being attached to an outflow pipe extending from a center portion of the inlet pipe and in fluid communication with the outlet conduit, a flow constriction located along a flow path from the inlet of the inlet pipe to the outlet conduit, the flow constriction and not the first flexible membrane or the second flexible membrane defining the water flow rate from the inlet to the outflow pipe.

26. The kit of claim 25, wherein the outflow pipe is extendable through a passage located in a side wall of the first flexible membrane or a passage located in a side wall of the second flexible membrane.

27. The kit of claim 25, wherein the flow constriction is adjustable in size to alter the water flow rate.

28. The kit of claim 25, further including at least one weight located within the inlet pipe for adjusting a buoyancy of the skimmer.

* * * * *